US006099384A

United States Patent [19]

Kube et al.

[11] Patent Number: 6,099,384

[45] Date of Patent: Aug. 8, 2000

[54] SIDE-SHIFTING MEASUREMENT DEVICE FOR A GRINDING MACHINE

[75] Inventors: Samuel C. Kube, Templeton; Albert A. Plekker, Natrona Heights, both of Pa.

[73] Assignee: K&P Microsystems, Inc., Ford City, Pa.

[21] Appl. No.: 09/085,384

[22] Filed: May 27, 1998

Related U.S. Application Data

[60] Provisional application No. 60/047,669, May 27, 1997.

[51] Int. Cl.[7] ..... B24B 49/00

[52] U.S. Cl. ..... 451/8; 451/49

[58] Field of Search ..... 451/8, 10, 11, 451/49, 50

[56] References Cited

U.S. PATENT DOCUMENTS 4,807,400 2/1989 Corallo et al. .
4,811,524 3/1989 Corallo .
5,203,615 4/1993 Zanetis et al. ..... 299/39
5,853,318 12/1998 Thom et al. ..... 451/425

*Primary Examiner*—Timothy V. Eley
*Assistant Examiner*—Dung Van Nguyen
*Attorney, Agent, or Firm*—Webb Ziesenheim Logsdon Orkin & Hanson, P.C.

[57] ABSTRACT

A side-shifting measurement device and method is provided for a grinding machine to measure the diameter of a roll being ground. The device includes a main frame located adjacent the grinding wheel and a side-shifting assembly mounted on the frame. A measuring device is mounted on the side-shifting assembly. The method includes mounting the side-shifting assembly adjacent to the grinding wheel, attaching a measuring device to the side-shifting assembly and contacting the measuring device with the roll such that the measuring device is located on a first side of the grinding wheel with respect to a grinding direction of the invention. When the grinding direction is reversed, the measuring device is laterally shifted from the first side of the grinding wheel to the second side of the grinding wheel.

22 Claims, 5 Drawing Sheets

SIDE-SHIFTING MEASUREMENT DEVICE FOR A GRINDING MACHINE

CROSS REFERENCE TO RELATED APPLICATION

This application claims the benefits of United States Provisional Application No. 60/047,669 filed on May 27, 1997 and entitled "Traveling Caliper".

1. Field of the Invention

This invention relates generally to the field of roll or cylinder grinding machines and, more particularly, to a side-shifting measurement or caliper device for a grinding machine.

2. Description of the Prior Art

Metal rolls are commonly used in both the steel and aluminum industry for rolling and shaping a metal piece. After continued use, these rolls become pocked and pitted and therefore must be replaced. Rather than being discarded, the used rolls can be ground on a grinding machine to refinish the roll surface so that the rolls can be reused.

Various types of grinding machines are known for grinding cylindrical objects, such as rolling mill work rolls and backup rolls, to refinish or smooth the rolls. These known devices are generally of two types. In the first type, known as a traveling carriage machine, the roll is rotated in a stationary position and a rotating grinding wheel is moved laterally along the roll to grind the roll to a desired diameter. In the second type, known as a traveling table machine, the rotating grinding wheel remains stationary while the spinning roll is passed along the grinding wheel.

The grinding operation is typically a multiple pass operation in which the roll, or the grinding wheel as the case may be, moves back and forth for several passes until a desired roll diameter or shape is obtained. As the roll is ground, it is very important to track the diameter or shape of the roll so that the grinding operation can be controlled. In older grinding machines, the roll diameter or shape was measured manually. However, this meant that the grinding operation would have to be stopped while the roll was measured. In more recent grinding machines, an automatic measurement device, such as a caliper device, is mounted on the machine and used to monitor the roll diameter or shape during grinding.

An example of a known traveling carriage grinding machine is described in U.S. Pat. No. 4,811,524 to Corallo, which is herein incorporated by reference. This known device includes a front bed having a pair of spaced apart steady rests designed to support the roll to be ground. Rotating devices for rotating the roll are located at the ends of the front bed. A rear bed is located adjacent to the front bed. A grinding carriage is movably mounted on the rear bed and contains a rotatable grinding wheel. The grinding carriage moves back and forth along the rear bed to grind the surface of the roll. A roll measuring device, typically in the form of a caliper device having extended caliper arms which contact the roll, is provided to monitor the "after grind" diameter or shape of the roll. The roll measuring device is typically mounted on a measurement carriage movable along a separate track attached to the front bed. The measurement carriage is movable independently of the grinding carriage and therefore must be controlled independently of the grinding carriage. In a traveling table grinding machine, the grinding carriage would be non-movably mounted on the rear bed while the front bed would be longitudinally movable to pass the roll back and forth along the grinding wheel.

The structure and operation of such known traveling carriage and traveling table grinding devices will be readily understood by one of ordinary skill in the art.

A problem with these known devices is that the separate track and independently movable measurement carriage system is very expensive to construct and maintain. For example, with a conventional traveling carriage machine, the track for the measurement carriage must extend along the full length of the front bed to accommodate the maximum roll length for the grinding machine.

Therefore, it is an object of the invention to provide a measurement device to measure the roll diameter or shape for a traveling carriage or traveling table grinding machine which is more economical to install and maintain than the measurement devices of the prior art. It is also an object of the invention to provide a movable measurement device which permits measurement of as much of the roll as possible while allowing the grinding wheel to move to its normal reversal point. It is further an object of the invention to provide a side-shifting measurement device which can be economically installed or retrofitted on an existing grinding machine to allow automatic measurement of the roll during grinding.

SUMMARY OF THE INVENTION

A side-shifting measurement device is provided for a grinding machine having a grinding wheel to grind a roll. The device includes a main frame located adjacent the grinding wheel and a side-shifting assembly mounted on the frame. A measuring device is mounted on the side-shifting assembly to measure the diameter or shape of the roll.

A method of measuring the diameter of a roll on a grinding machine having a grinding wheel is also provided. The method includes mounting a side-shifting assembly adjacent to the grinding wheel, attaching a measuring device to the side-shifting assembly and contacting the measuring device with the roll such that the measuring device is located at a first position with respect to the grinding wheel. This first position can be in front of, behind or aligned with the grinding wheel with respect to a grinding direction of the invention. The measuring device may be laterally shifted from the first position with respect to the grinding wheel to a second position with respect to the grinding wheel in order to avoid the measuring device slipping off of the end of the roll when the grinding direction is reversed or if an obstacle is to be avoided or to adjust to a desired position with respect to the grinding wheel. For one given reversal sequence, more than one lateral shift may be needed to complete the desired positioning of the measuring device.

A complete understanding of the invention will be obtained from the following description when taken in connection with the accompanying drawing figures wherein like reference characters identify like parts throughout.

DESCRIPTION OF THE PREFERRED EMBODIMENTS

Figure 1:
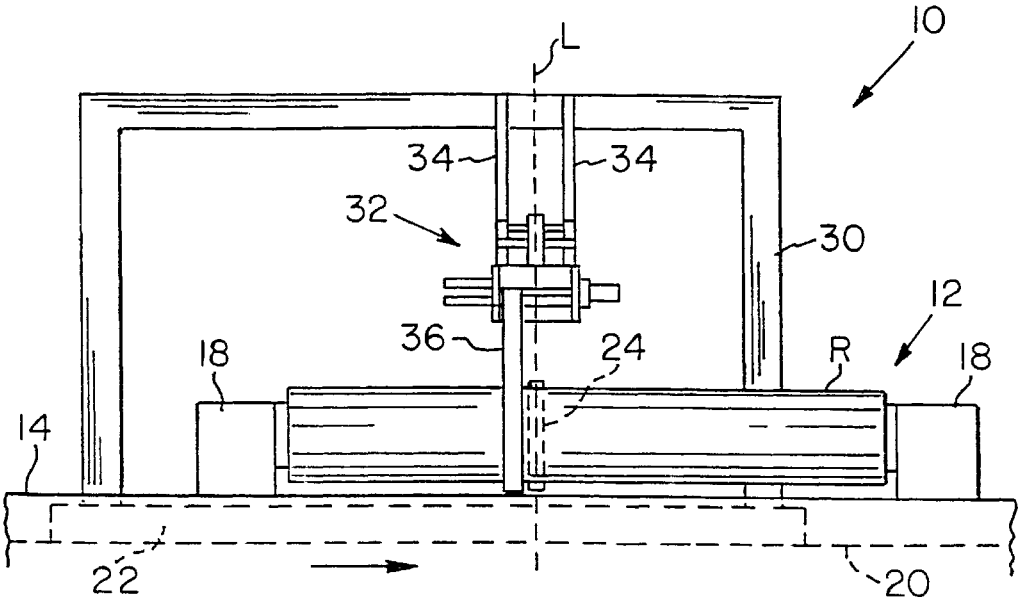
FIGS. 1–4 are front, schematic views of a first embodiment of a side-shifting measurement device of the invention mounted on a traveling carriage machine.

For purposes of the description hereinafter, the terms "upper", "lower", "right", "left", "vertical", "horizontal", "top", "bottom", "front", "rear" and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

A first embodiment of a side-shifting measurement device of the invention is generally designated 10 in FIGS. 1–4 of the drawings. This first embodiment of the device 10 is particularly well suited for use with a conventional traveling carriage machine 12, as schematically shown in FIGS. 1–4 of the drawings. Since the structure and operation of a traveling carriage machine 12 is well-known, the components of the traveling carriage machine 12 are only schematically shown in order to explain the structure and operation of the measurement device 10. The traveling carriage machine 12 includes a stationary front bed 14 on which a roll R may be rotatably mounted via a pair of opposed steady rests 18. A rear bed 20 is located behind the front bed 14, with a grinding carriage 22 movably mounted on the rear bed 20. A grinding wheel 24 is mounted on the grinding carriage 22. The device 10 includes a main boom or frame 30 mounted on the movable grinding carriage 22 of the traveling carriage machine 12. The frame 30 is preferably made of metal. A side-shifting assembly 32 is mounted on the frame 30, for example by a pair of spaced apart arms 34. A roll measuring device 36, such as a conventional caliper device having a pair of caliper arms, is mounted on the side-shifting assembly 32.

Figure 5:
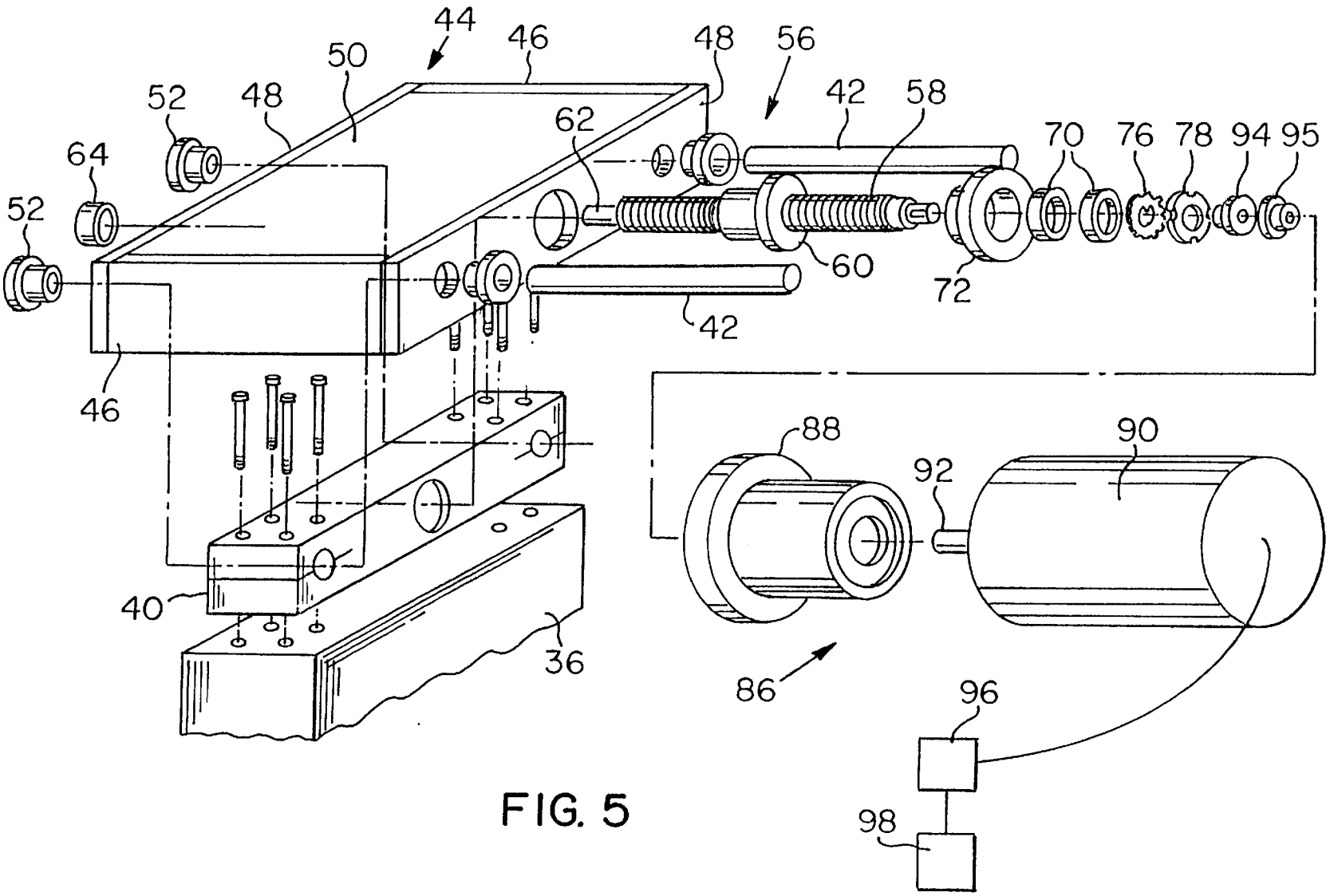
FIG. 5 is an exploded view of a side-shifting assembly of the device shown in FIGS. 1–4.

As shown in detail in FIG. 5 of the drawings, the side-shifting assembly 32 includes a mounting block 40 mounted on a pair of spaced apart rods or slide ways 42 extending through a rigid auxiliary frame 44. The auxiliary frame 44 includes a pair of opposed end plates 46, a pair of opposed side plates 48 and a top 50. The mounting block 40 is slidably movable in the auxiliary frame 44 on the slide ways 42, which pass through and are supported by bearings 52 attached to the side plates 48. A ball screw assembly 56 having a threaded rod 58 and nut 60 extends through the mounting block 40, with the nut 60 attached to the mounting block 40 so that the mounting block 40 and nut 60 form a single unit.

One end of the threaded rod 58 is machined to form a smooth shaft portion 62 which fits into a radial bearing 64 attached to one of the side plates 48. The other end of the threaded rod 58 is machined to form steps to provide a bearing fit for a pair of thrust bearings 70 which are sealed in a bearing housing 72 attached to one of the side plates 48. A threaded portion is provided to engage a lock washer 76 and lock nut 78 which, when installed, apply a load to the thrust bearings 70. A smaller, smooth shaft section having a keyway is provided for installing a coupling device 82 to connect the threaded rod 58 to a rotating drive device, such as a motor assembly 86.

A driver mounting adapter 88 is attached to one of the side plates 48, for example, by screws, so that a driver, such as an electric servo motor 90 having a rotatable shaft 92, may be attached to the end of the adapter 88 and fixedly held relative to the auxiliary frame 44. The motor 90 is a bidirectional motor, i.e., it can rotate both clockwise and counterclockwise. The adapter 88 is designed so that the motor 90 is located at a spaced distance from the side plate 48 to which it is attached. This allows coupler halves 94 and 95 to be mounted on the threaded rod end shaft and the motor shaft 92 and to be joined together such that rotational motion of the motor 90 is transferred through the connected coupler halves 94 and 95 to the threaded rod 58.

The rotating motion of the threaded rod 58 causes the nut 60 to move to the left or the right on the threaded rod 58, depending on the rotational direction of the rod 58. The nut 60 is prevented from turning since it is mounted within the mounting block 40, which in turn is prevented from turning by the two slide ways 42 passing through the side plates 48. If the threaded rod 58 is of a right hand configuration, clockwise rotation of the motor 90 and hence the threaded rod 58 will cause the mounting block 40 to move to the right while counterclockwise rotation of the motor 90 and hence the threaded rod 58 will cause the mounting block 40 to move to the left. The motor 90 is electronically connected to an electronic position feed back device 96 connected to a control system 98 for the machine 12.

The measurement device 36 is fastened to the mounting block 40, preferably by screws, so that the measuring device 36, the mounting block 40 and the nut 60 act as a single unit to move left or right in response to the rotation of the threaded rod 58. Operation of the measurement device 10 will be described in detail hereinbelow.

Figure 6:
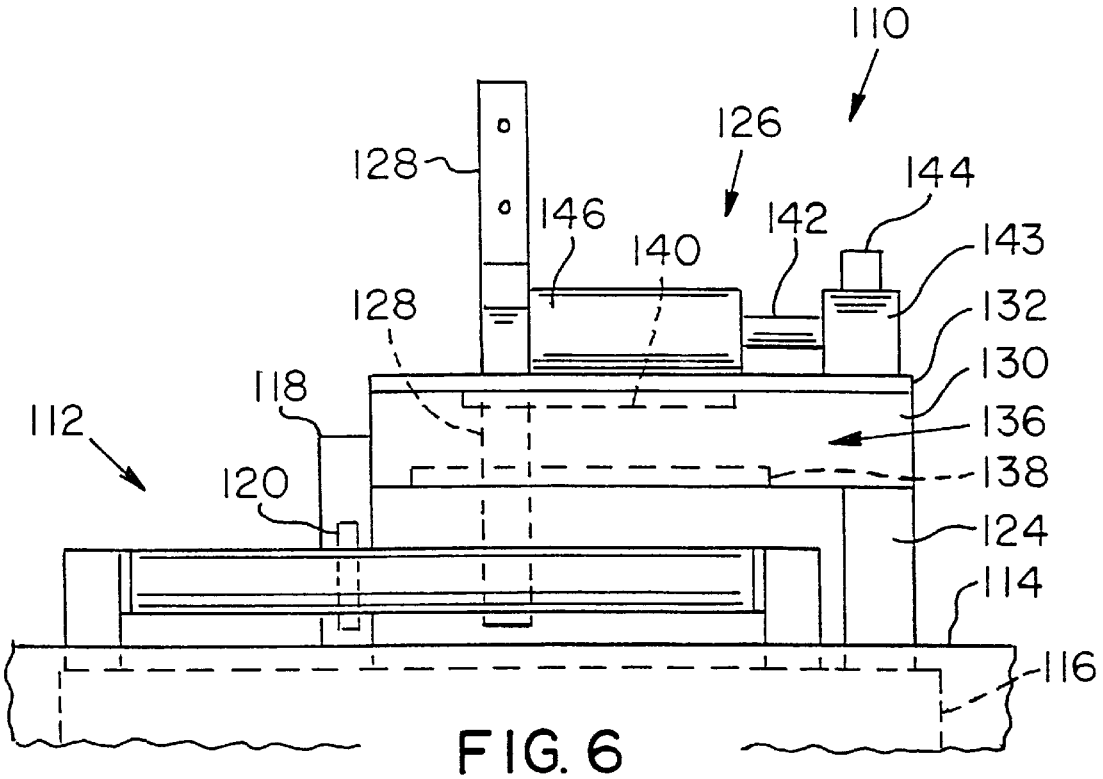
FIG. 6 is a front, schematic view of a second embodiment of the side-shifting measurement device of the invention mounted on a traveling table machine.
Figure 7:
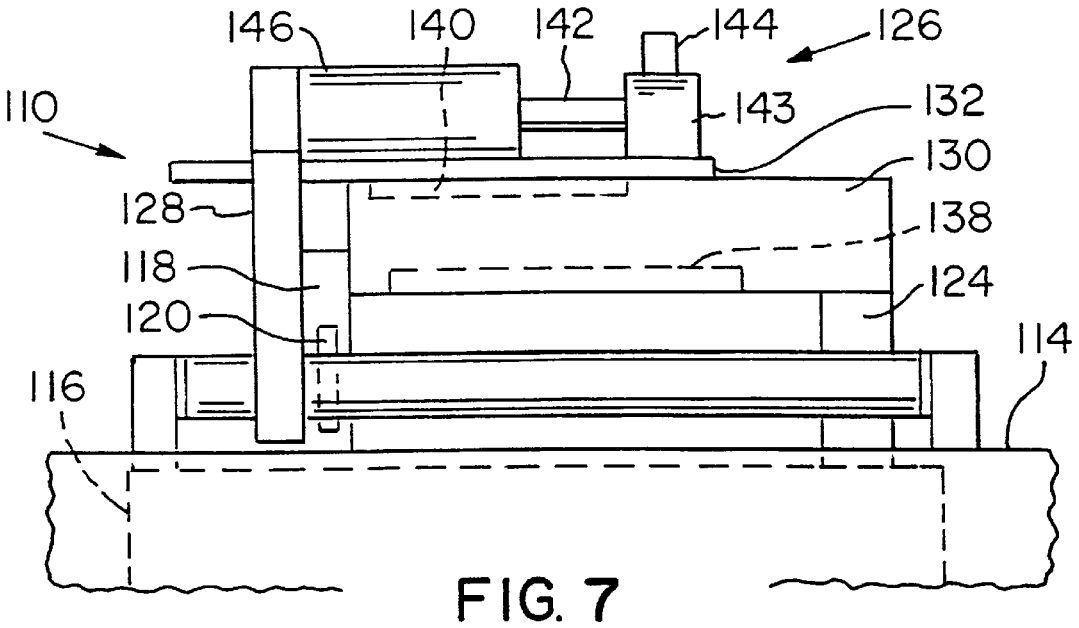
FIG. 7 is a front, schematic view of the side-shifting measurement device of FIG. 6 with the measurement device in a lowered position.

A second embodiment of a side-shifting measurement device of the invention is generally designated 110 in FIGS. 6 and 7 of the drawings. This second embodiment is particularly well suited for use with a traveling table machine 112 and is schematically shown mounted on such a machine. The traveling table machine 112 has a laterally movable front bed 114 upon which a roll R may be rotatably mounted. A stationary grinding or rear bed 116 is located adjacent the front bed 114. A stationary grinding device 118 having a grinding wheel 120 is mounted on the rear bed 116. The general structure of such a traveling table machine 112 will be readily understood by one of ordinary skill in the art and therefore the components of the traveling table machine 112 are only schematically shown to explain the structure and operation of the device 110. The measurement device 110 includes a main boom or frame 124 mounted on the stationary rear bed 116 adjacent the grinding wheel 120. A side-shifting assembly 126 is mounted on the frame 124 and a conventional roll measuring device 128 is mounted on the side-shifting assembly 126.

The side-shifting assembly 126 includes a motor enclosure 130 with a platform or shelf 132 slidably mounted on the enclosure, for example, by a conventional track mechanism. A linear motor assembly 136 is located in the motor enclosure 130. A first component 138 of the linear motor assembly 136 is fixedly mounted in the motor enclosure 130 and a second component 140 is attached to the bottom of the shelf 132. While not specifically shown, the linear motor assembly 136 is electronically connected to a position feedback device and a control system in similar manner as described above.

The measuring device 128 is attached to the end of a shaft 142 connected through a gear box 143 to a pivot motor 144 such that rotation of the motor 144 rotates the measuring device 128 from an upper, non-engaged position shown in solid lines in FIG. 6 of the drawings to a lower, engaged position shown in dashed lines in FIG. 6 of the drawings. A bearing block 146 is preferably located between the measuring device 128 and the gear box 143. The linear motor assembly 136 moves the shelf 132 between a rightmost position, as shown in FIG. 6 of the drawings in which the measuring device 128 is on one side of the grinding wheel 120, to a leftmost position, as shown in FIG. 7 of the drawings in which the measuring device 128 is positioned on the other side of the grinding wheel 120.

Figure 8:
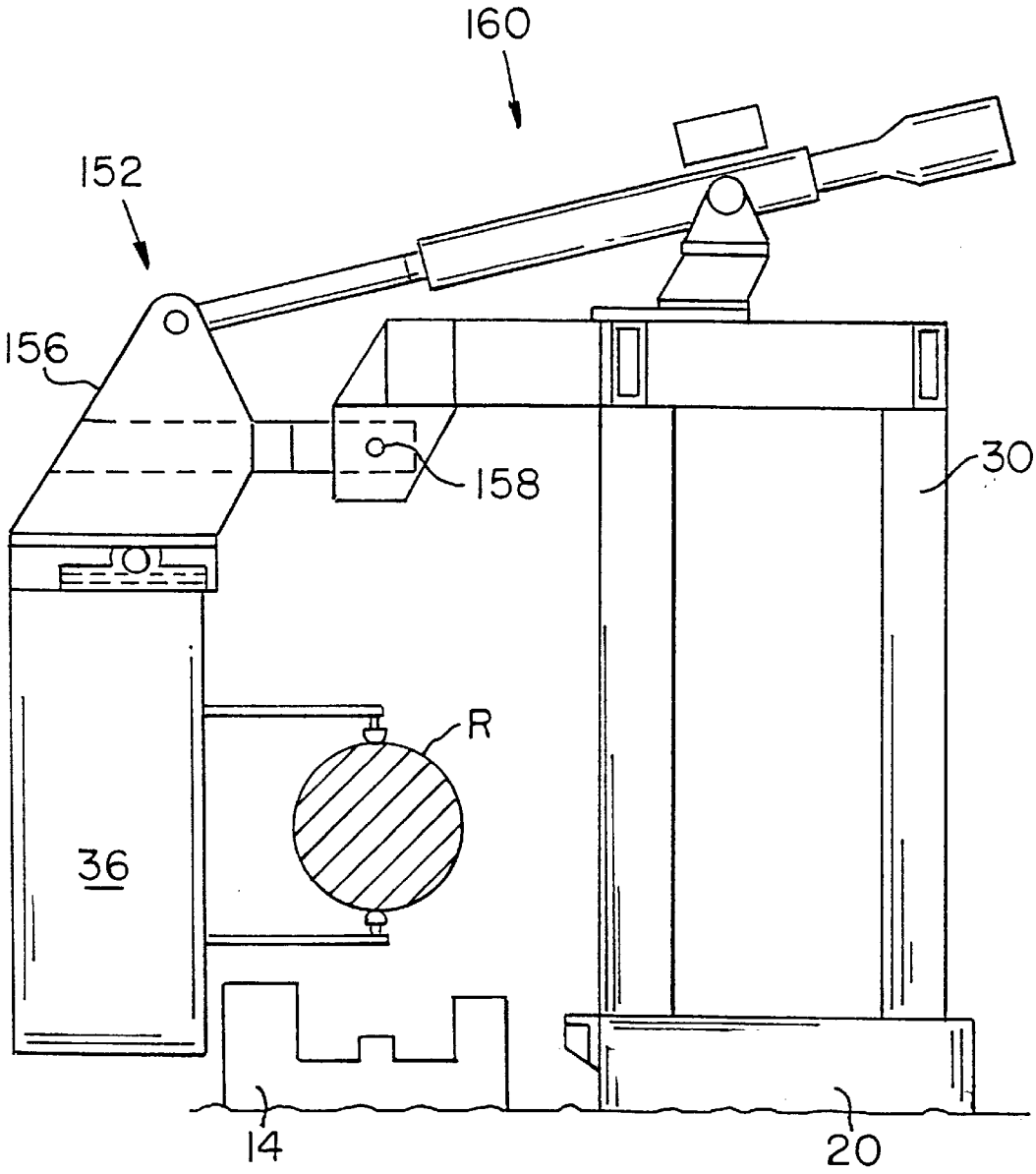
FIG. 8 is an end view of a third embodiment of a device similar to that shown in FIGS. 1–4 but having a pivoting mechanism.

A third embodiment of a side-shifting measurement device of the invention is designated 152 in FIG. 8 of the drawings. This device 152 is a modified version of the device 10 shown in FIGS. 1–4 of the drawings. In this embodiment, the side-shifting assembly 32 is mounted on an extension member 156 pivotally mounted on the frame 30, such as by a pivot pin 158. The extension member 156 is preferably configured as a pair of spaced apart plates with the side-shifting assembly 32 mounted between the plates. A pivot mechanism, such as a piston and cylinder assembly 160, is mounted on the frame 30, with the outer end of the piston rod pivotally connected to the extension member 156. As shown in FIG. 8, extension of the piston rod rotates the measuring device 36 downwardly to engage the roll R. Retraction of the piston rod rotates the measuring device 36 upwardly to move the measuring device 36 away from the roll R.

Operation of the side-shifting measurement devices of the invention will now be described. Looking first at the device 10 shown in FIGS. 1–4, as shown in FIG. 1 of the drawings, the frame 30 is attached to the grinding carriage 22 and thus moves as the grinding carriage 22 moves. Therefore, no additional tracks or drive systems are required. This eliminates the need for a separate track for the measuring device 36 and the associated controls. The side-shift assembly 32 is preferably mounted on the frame 30 such that a center line L of the auxiliary frame 44 is aligned with the center line of the grinding wheel 24. The auxiliary frame 44 preferably has a width of about 14–17 inches so that the measuring device 36 has a lateral movement of about 7–8.5 inches on either side of the center line of the grinding wheel 24.

Figure 2:
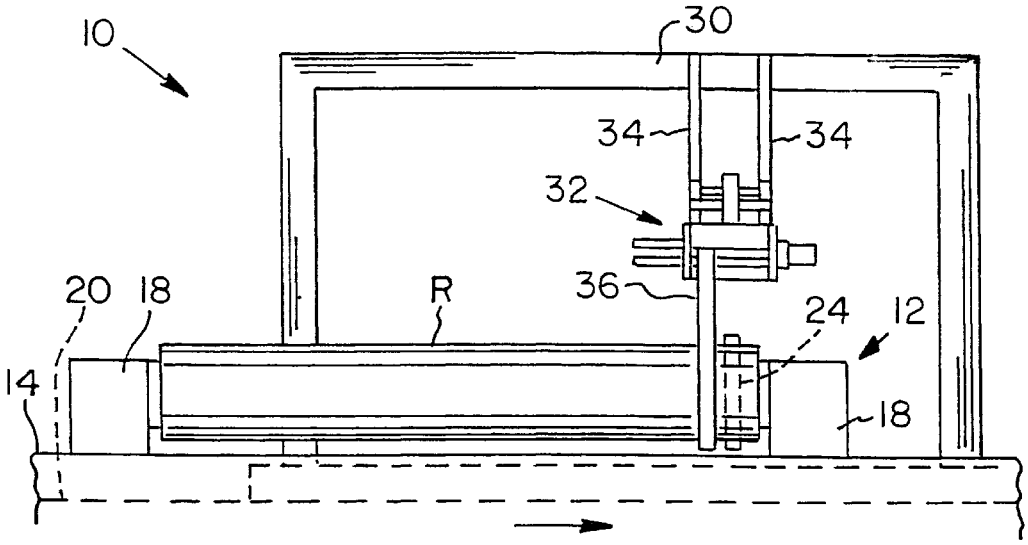
Figure 3:
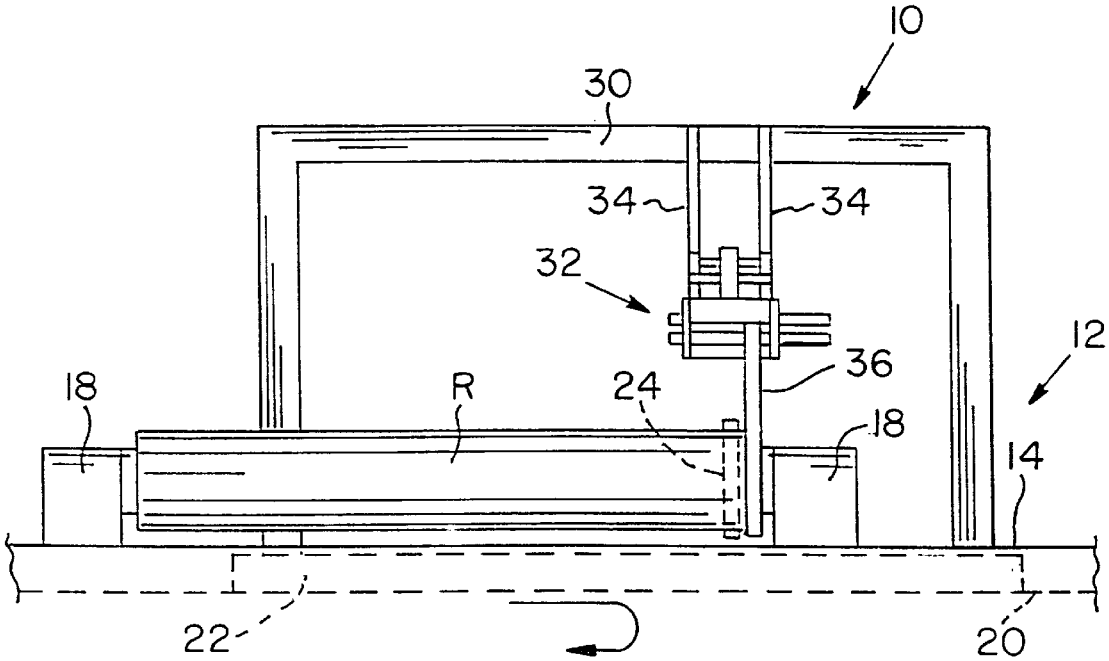
Figure 4:
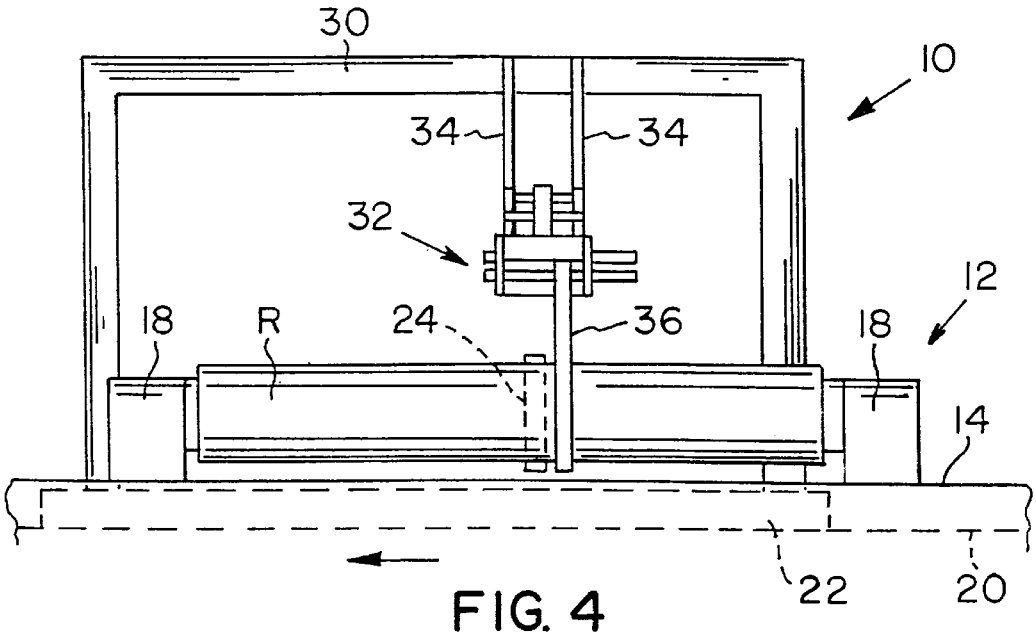

For purposes of explanation, if the grinding carriage 22 is moving to the right, as shown in FIG. 1 of the drawings, the motor 90 may be activated to rotate the threaded rod 58 to position the measuring device 36 to a first selected position with respect to the grinding wheel 24. This first selected position may be in front of, aligned with or behind the grinding wheel 24 with respect to a grinding direction of the grinding carriage 22. In most operations, the "after grind" measurement is desired. Therefore, the measuring device 36 is preferably positioned such that the measuring device 36 is either aligned with the centerline of the grinding wheel 24 or such that the measuring device 36 is located behind the grinding wheel 24 with respect to a direction of travel of the grinding carriage 22 during the grinding pass. In FIGS. 1 and 2, the measuring device 36 is shown positioned behind the grinding wheel 24, i.e., to the left with respect to the grinding direction. Thus, as the carriage 22 moves to the right, the measuring device 36 is carried along on the grinding carriage 22 and follows the grinding wheel 24 to provide a true "after grind" measurement. As shown in FIG. 2 of the drawings, the measuring device 36 continues to follow the grinding wheel 24 toward the right end of the roll R. As shown in FIG. 3 of the drawings, at the end of the grinding pass when the grinding wheel 24 reaches the rightmost end of the roll R, the grinding wheel 24 stops its lateral movement and reverses grinding direction to begin a grinding pass in the opposite direction of travel. During this reversing sequence, the motor 90 is energized to rotate the threaded rod 58 to move the measuring device 36 along the roll from the first selected position on the left side of the auxiliary frame 44 toward a second selected position on the right side of the auxiliary frame 44, as shown in FIG. 3 of the drawings. The measuring device 36 is moved laterally toward the right to measure substantially the entire roll length but is not moved so far as to slip off of the end of the roll R. When the grinding wheel 24 reaches a desired distance from the measuring device 36, i.e., a second selected position, the side-shifting stops. The measuring device 36 is thus once again placed in a position to follow the grinding wheel 24 as the grinding pass is made in the opposite direction. At the other end of the roll R, the motor 90 would again be energized to move the measuring device 36 from the right side of the auxiliary frame 44 to the left side of the auxiliary frame 44 to once again follow the grinding wheel 24 along its grinding pass.

Rather than following the grinding wheel 24, it may also be desirable to position the measuring device 36 along the centerline of the grinding wheel 24 during the grinding pass. In this configuration, the side-shifting assembly 32 may be used to prevent the measuring device 36 from moving off the end of the roll R during the grinding wheel reversing sequence. During the reversing sequence, it is typical for more than half the width of the grinding wheel 24 to be off of the end of the roll R at the reversal point of the grinding wheel 24. This means that, without lateral shifting, the measuring device 36, for example the calipers, could slip off of the end of the roll R. Therefore, as the grinding wheel 24 approaches the end of the roll R, for example the right end as shown in FIG. 1 of the drawings, the control system 98 activates the motor assembly 86 to move the measuring device 36 to the left at substantially the same speed as the grinding carriage 22 is moving to the right. This essentially maintains the measuring device 36 at a stationary position at or near the end of the roll R as the grinding wheel 24 continues to move to the right to its reversal point. At the reversal point, the grinding carriage 22 reverses direction and begins to moving toward the left. As this occurs, the control assembly 98 activates the motor 90 to move the measuring device 36 to the right in the auxiliary frame 44 at about the same speed as the grinding carriage 22 until the centerline of the grinding wheel 24 is once again aligned with the measuring device 36. At this point, the motor 90 is stopped and the measuring device 36 is carried along the grinding pass by the grinding carriage 22 to the other end of the roll R, where a similar reversing sequence takes place.

Additionally, the side-shifting assembly 32 can be used to prevent the measuring device 36 from contacting obstacles along the grinding path which could damage the measuring device 36 during the grinding pass. For example, if the steady rests 18 of the grinding machine 12 are so configured that the measuring device 36 could contact the steady rests 18 near the ends of the grinding pass, the side-shifting assembly 32 may be used to avoid such contact. This is accomplished in similar manner as described above with respect to preventing the measuring device 36 from slipping off of the end of the roll R. If the grinding carriage 22 is traveling to the right, for example, as the measuring device 36 approaches the rightmost steady rest 18, the control system 98 activates the motor 90 to move the measuring device 36 to the left in the auxiliary frame 44 at substantially the same speed as the grinding carriage 22 is moving to the right. This essentially maintains the measuring device 36 at a stationary position with respect to the roll while the grinding carriage 22 and grinding wheel 24 continue to the right to the normal reversing position. As the grinding carriage 22 reverses direction, the control assembly 98 activates the motor 90 to move the measuring device 36 to the right in the auxiliary frame 44 at about the same speed as the grinding carriage 22 until the measuring device 36 is at a desired position with respect to the grinding wheel 24, at which time the motor 90 is stopped and the measuring device 36 is once again moved along with the grinding carriage 22. A similar reversing sequence would take place at the other end of the roll R near the leftmost steady rest 18.

Operation of the device 110 shown in FIGS. 6 and 7 of the drawings will now be described. In this embodiment, the frame 124 is fixedly mounted on the stationary rear grinding bed 116 and extends above the stationary grinding wheel 120. Initially, the measuring device 128 is in the raised position shown in solid lines in FIG. 6 of the drawings in which the measuring device 128 is not in a position to contact the roll R. After the roll R to be processed is placed on the traveling or front bed 114, the motor 144 is energized to rotate the measuring device 128 from the upper position shown in solid lines in FIG. 6 of the drawings to the lower position shown in dashed lines in FIG. 6 of the drawings in which the measuring device 128 is in a position to contact the roll. Depending upon the direction of movement of the roll R, the measuring device 128 is initially side-shifted laterally by the linear motor assembly 136 to be positioned at a first desired position with respect to the grinding wheel 120. This first position could be, for example, either in front of, behind or aligned with the grinding wheel 120. In FIG. 7 of the drawings, the roll R is being traversed to the right and the measuring device 128 is shown placed to the left of the grinding wheel 120, i.e., behind the grinding wheel 120 with respect to a grinding direction.

As the leftmost end of the roll R reaches the grinding wheel 120, the front bed 114 is reversed to begin another grinding pass along the roll in the opposite direction, i.e., to the left. During this direction shift, the linear motor assembly 136 is energized in similar manner as described above to laterally shift the measuring device 128 from the left side of the grinding wheel 120, as shown in FIG. 7 of the drawings, to the right side of the grinding wheel 120, as shown in dashed lines in FIG. 6 of the drawings to measure the roll diameter or shape while maintaining the measuring device 128 in contact with the roll R. When the desired diameter or shape of the roll R is reached, the grinding machine 120 is stopped and the motor 144 activated to rotate the measuring device 128 upwardly and away from the roll R so that the finished roll R may be easily and quickly removed from the machine 112. Rotation of the measuring device 126 allows for greater access to the roll R and thus permits easier placement and removal of the roll R on the machine 112.

Of course, if desired, the measuring device 128 could be aligned with the centerline of the grinding wheel 120 during the grinding pass. As the end of the roll R approaches the grinding wheel 120, the side-shifting assembly 126 laterally moves the measuring device 128 in similar manner as described above to prevent the measuring device 128 moving off the end of the roll R during the reversing cycle. Additionally, the side-shifting assembly 126 can also be used in similar manner as described above to prevent the measuring device 128 from contacting objects, such as the steady rests, during the grinding pass.

Operation of the device 152 shown in FIG. 8 of the drawings is similar to that discussed above with respect to FIGS. 1–4 of the drawings. However, in this embodiment, the piston and cylinder assembly 160 may be activated to raise and lower the measuring device 36 to move the measuring device 36 away from the roll R to assist in removing the roll R from the grinding machine 12.

Thus, the present invention provides an economical method of mounting a roll measuring device on a grinding machine, such as a traveling carriage machine, without the need for the expensive and complex front mounted track and carriage systems of the prior art. The side-shifting assembly of the invention allows the measuring device to be placed at a desired first position with respect to the grinding wheel, i.e., in front, behind or centered, and then laterally shifted to prevent the measuring device from moving off of the end of the roll or to avoid contact with obstacles which could damage the measuring device.

It will readily be appreciated by those skilled in the art that modifications may be made to the invention without departing from the concepts disclosed in the foregoing description. For example, although the preferred embodiments of the side-shifting assembly are presented herein, other side-shifting mechanisms could also be used, such as conventional piston/cylinder devices, hydraulic devices, electromechanical devices, etc. Such modifications are to be considered as included within the following claims unless the claims, by their language, expressly state otherwise. Accordingly, the particular embodiments described in detail hereinabove are illustrative only and are not limiting as to the scope of the invention which is to be given the full breadth of the appended claims and any and all equivalents thereof.

We claim:

1. A side-shifting measurement device for a grinding machine having a grinding wheel to grind a roll, comprising:

a main frame arranged to be located adjacent the grinding wheel;

a side-shifting assembly mounted on said frame; and a measuring device mounted on said side-shifting assembly, said measuring device being selectively, laterally movable by said side-shifting assembly between a first position on one side of the grinding wheel and a second position on the other side of the grinding wheel.

2. The device as claimed in claim 1, wherein said side-shifting assembly includes:

an auxiliary frame connected to said main frame; and a mounting block laterally movable in said auxiliary frame, wherein said measuring device is mounted to said mounting block such that lateral movement of said mounting block causes lateral movement of said measuring device.

3. The device as claimed in claim 2, including a pair of opposed slide ways located on said auxiliary frame, wherein said mounting block is mounted on said slide ways.

4. The device as claimed in claim 2, including a motor connected to said mounting block such that rotation of said motor causes said mounting block to laterally move in said auxiliary frame.

5. The device as claimed in claim 4, including a ball screw assembly having a threaded rod connected to said motor and said mounting block such that rotation of said threaded rod laterally moves said mounting block in said auxiliary frame.

6. The device as claimed in claim 4, wherein said motor is connected to a position feed back device to sense the position of said mounting block in said auxiliary frame.

7. The device as claimed in claim 6, wherein said position feed back device is connected to a control system to control said motor to selectively position said measuring device.

8. The device as claimed in claim 1, wherein said side-shifting assembly includes a laterally movable shelf, with said measuring device mounted on said shelf.

9. The device as claimed in claim 8, wherein said shelf is slidably carried on a motor enclosure having a linear motor assembly, with one portion of said linear motor assembly fixedly mounted in said motor enclosure and another portion of said linear motor assembly mounted on a bottom of said shelf.

10. The device as claimed in claim 8, wherein said measuring device is pivotally mounted on a shaft.

11. The device as claimed in claim 10, wherein said shaft is rotatably connected to a pivot motor such that rotation of said pivot motor causes said measuring device to pivot between a first position in which said measuring device is not in a position to contact the roll and a second position in which said measuring device is in a position to contact the roll.

12. The device as claimed in claim 1, wherein said side-shifting assembly is mounted on an extension member mounted on said frame.

13. The device as claimed in claim 12, wherein said extension member is pivotally mounted to said main frame.

14. The device as claimed in claim 13, including a pivot mechanism mounted on said main frame and connected to said extension member to cause said measuring device to pivot between a first position in which said measuring device is not in a position to contact the roll and a second position in which said measuring device is in a position to contact the roll.

15. A method of measuring a roll on a grinding machine having a grinding wheel, comprising the steps of:

mounting a side-shifting assembly adjacent to the grinding wheel, said side-shifting assembly having a measuring device;

positioning said measuring device at a first selected position with respect to the grinding wheel for a first grinding direction;

laterally shifting said measuring device with respect to the grinding wheel such that said measuring device remains in contact with the roll when the grinding direction reverses from the first grinding direction to a second grinding direction or such that said measuring device does not contact an obstacle; and laterally shifting said measuring device to a second selected position with respect to the grinding wheel for the second grinding direction.

16. The method as claimed in claim 15, including pivoting said measuring device from a position in which said measuring device is not in a position to contact the roll to a position in which said measuring device is in a position to contact the roll.

17. The method as claimed in claim 15, wherein the grinding machine is a traveling carriage machine having a grinding carriage and the method includes mounting said side-shifting assembly on the grinding carriage.

18. The method as claimed in claim 15, wherein the grinding machine is a traveling bed machine having a stationary grinding bed with a stationary grinding wheel and the method includes mounting said side-shifting assembly on the stationary grinding bed.

19. The method as claimed in claim 15, wherein said side-shifting assembly includes a motor assembly and the method includes activating said motor assembly to cause lateral movement of said measuring device when the grinding direction reverses in order to avoid said measuring device slipping off an end of the roll or to avoid an obstacle when the grinding direction reverses.

20. The method as claimed in claim 15, wherein said first selected position is in front of, aligned with or behind the grinding wheel with respect to said first grinding direction.

21. The method as claimed in claim 15, wherein said second selected position is in front of, aligned with or behind the grinding wheel with respect to said second grinding direction.

22. A side-shifting measurement device for a grinding machine having a grinding wheel to grind a roll, comprising:

means for mounting a side-shifting assembly adjacent to the grinding wheel, said side-shifting assembly having a measuring device;

means for positioning said measuring device at a first position with respect to the grinding wheel for a first grinding direction;

means for laterally shifting said measuring device with respect to the grinding wheel such that said measuring device remains in contact with the roll when the grinding direction reverses from the first grinding direction to a second grinding direction or such that said measuring device does not contact an obstacle; and means for laterally shifting said measuring device to a second selected position with respect to the grinding wheel for the second grinding direction.

* * * * *